US007797863B2

(12) United States Patent
Moreno Jordana

(10) Patent No.: US 7,797,863 B2
(45) Date of Patent: Sep. 21, 2010

(54) IRON SOLE AND IRON CONTAINING SAME

(75) Inventor: Luis Moreno Jordana, Saragossa (ES)

(73) Assignee: Celaya, Emparanza y Galdos, Internacional, S.A., Vitoria (Alava) (ES)

( * ) Notice: Subject to any disclaimer, the term of this patent is extended or adjusted under 35 U.S.C. 154(b) by 23 days.

(21) Appl. No.: 12/162,773

(22) PCT Filed: Jan. 30, 2007

(86) PCT No.: PCT/ES2007/070021

§ 371 (c)(1),
(2), (4) Date: Jul. 30, 2008

(87) PCT Pub. No.: WO2007/088233

PCT Pub. Date: Aug. 9, 2007

(65) Prior Publication Data

US 2009/0019737 A1 Jan. 22, 2009

(30) Foreign Application Priority Data

Jan. 31, 2006 (ES) ..... 200600259

(51) Int. Cl.
*D06F 75/38* (2006.01)
*D06F 75/08* (2006.01)

(52) U.S. Cl. ..... 38/93

(58) Field of Classification Search ..... 38/77.7, 38/77.83, 77.9, 82, 93, 88; 219/245, 254, 219/260; 427/456, 457; 428/457, 443.1, 428/460.1, 466.1, 468.2, 451.1, 540, 547, 428/548

See application file for complete search history.

(56) References Cited

U.S. PATENT DOCUMENTS 2,976,386 A * 3/1961 Salton ..... 219/450.1
3,067,315 A * 12/1962 Hurko ..... 219/543
3,811,934 A * 5/1974 Glaser ..... 428/626
3,895,218 A * 7/1975 Cooke ..... 219/543
4,057,707 A * 11/1977 Allen ..... 219/543
4,117,612 A 10/1978 Baumgartner et al.
4,122,615 A * 10/1978 Baumgartner et al. ..... 38/93
4,702,933 A * 10/1987 Kramer ..... 427/453

(Continued)

FOREIGN PATENT DOCUMENTS

| | | | |
|---|---|---|---|
| EP | 0158779 | A1 | 10/1985 |
| EP | 0201967 | A1 | 11/1986 |
| EP | 0891118 | A1 | 1/1999 |
| ES | 456442 | | 1/1978 |
| FR | 2189562 | | 1/1974 |
| WO | WO 9302533 | A1 | 2/1993 |

OTHER PUBLICATIONS

International Search Report for International Application No. PCT/ES2007/070021, 31.02.2007, Madrid.
Written Opinion for International Searching Authority for International Application No. PCT/ES2007/070021 (English Translation), 31.02.2007, Madrid.

*Primary Examiner*—Ismael Izaguirre
(74) *Attorney, Agent, or Firm*—Peter B. Scull; Kristina M. Kalan; Berenbaum Weinshienk PC

(57) ABSTRACT

Iron's soleplate comprising a body that is a single ceramic plate (1) having an ironing outer side and an inner side (11), and a heating element having at least one screen-printed resistance (2) on said inner side of the ceramic plate. The ceramic plate is made of alumina or a glass-ceramic material and is provided with some steam outlets (3). The ironing outer side of the ceramic plate is uniformly granulated, in order to form a plurality of micro-channels for uniformly distributing the steam, or else is smooth and is provided with some channels for distributing the steam too.

20 Claims, 2 Drawing Sheets

U.S. PATENT DOCUMENTS 4,822,686 A * 4/1989 Louison et al. ..... 428/457
4,835,363 A * 5/1989 Hoffmann ..... 219/258
5,146,700 A 9/1992 Prosser
5,392,542 A * 2/1995 Chang ..... 38/93
6,018,897 A * 2/2000 Lin ..... 38/82
6,144,014 A * 11/2000 Dodier et al. ..... 219/256
6,216,369 B1 * 4/2001 Wolf et al. ..... 38/93
6,465,763 B1 * 10/2002 Ito et al. ..... 219/444.1
6,639,188 B2 * 10/2003 Ito ..... 219/444.1
6,895,700 B2 * 5/2005 Lukas et al. ..... 38/93

* cited by examiner

IRON SOLE AND IRON CONTAINING SAME

The present invention relates to an iron's soleplate comprising a body and a heating element for heating said body, and to an iron comprising such a soleplate.

BACKGROUND ART

The irons for ironing clothes are provided with a soleplate, which is the element that slides on the fabric while heating it. Such irons often comprise a steam generator, in which case the soleplate comprises some steam outlets.

The soleplate's outer surface should slide smoothly on the fabric, and the soleplate should cope with both high temperatures and sudden changes of temperature. Moreover, the soleplate should be resistant to blows and scratches.

Conventional irons have a metallic soleplate, normally made of an aluminium substrate coated (on the ironing side) with a layer of stainless steel, anodized aluminium or enameled aluminium. The soleplate is heated by heating elements usually in the form of electric resistances embedded in the soleplate. Such resistances have normally a tubular shape, so that they can be bent but with a minimum radius that is quite large.

Such conventional irons present, among others, the following drawbacks: the stainless steel coating is scratched with use, the soleplate is heavy, the heat distribution in the soleplate is not uniform, the resistances are large and impose limitations on the soleplate's geometry, the heat transmission from the aluminium to the stainless steel is bad and must be helped by using conductive pastes.

Metallic soleplates with embedded resistances coated with a glass-ceramic material are known too. Glass-ceramics materials are very hard and present high thermal and mechanical resistance.

Spanish patent No. 456442 discloses an iron's soleplate made of a thick inner plate having slanted surfaces which face each other and can be moved to fasten the soleplate to the iron's case, and a thinner outer plate welded to the inner plate. The resistances are embedded between the two plates and the plates can be made of, among others, a glass-ceramic material.

PCT application No. WO 93/02533 discloses an iron's soleplate consisting of a metallic substrate coated with a glass-ceramic material on both sides. Heating tracks are arranged on the inner side; said tracks contain platinum or any conductive material the electric conductivity of which conveniently decreases when increasing the temperature, thus providing a thermal self-control.

By using the soleplate's configuration disclosed in these documents, the heat must pass through several layers of materials having different thermal properties (heating capacity, thermal expansion, etc), thus making difficult the heat transmission and making likely the formation of cracks. Besides, the need to house so much material rests space for other elements of the iron and makes it heavy.

SUMMARY OF THE INVENTION

It is an object of the present invention to provide an iron's soleplate that, while occupying less space than known soleplates, yet is sufficiently robust.

According to one aspect of the invention, the body of the soleplate is a single ceramic plate having an ironing outer side and an inner side, and the heating element comprises at least one screen-printed resistance on said inner side of the ceramic plate.

In this way, the soleplate is light, thin, resistant to scratches and blows and robust, because by virtue of being an unitary soleplate there is no danger that the different thermal properties of the different materials will cause cracks. Moreover, the screen-printed resistances take little space and can have a geometry that may present more variety than the geometries of the classical tubular resistances.

Besides, the heat transmission to the ironing outer side of the soleplate is improved thanks to the latter being unitary.

In an embodiment, the ceramic plate is provided with some steam outlets and, advantageously, the ironing outer side of the ceramic plate is uniformly granulated, in order to form a plurality of micro-channels for uniformly distributing the steam, although in another embodiment the ironing outer side of the ceramic plate is provided with some channels also intended for distributing the steam.

In an embodiment, the ceramic plate is made of a glass-ceramic material, and in another embodiment the ceramic plate is made of alumina. The thickness of the ceramic plate is in the range 2-5 mm, preferably in the range 3-4 mm.

Glass-ceramic materials are resistant to scratches and blows, stains, acids, high temperatures and sudden changes of temperature. They also have better sliding properties and the edges of a glass-ceramic soleplate are not very hot, thus protecting the user from accidental burns.

Alumina is resistant to scratching, acids and high temperatures, and can be made with a wide range of colours.

According with another aspect of the invention, and iron comprises a soleplate as defined in this section.

BRIEF DESCRIPTION OF THE DRAWINGS

Some particular embodiments of the present invention will be described in the following, only by way of non-limiting example, with reference to the appended drawings, in which.

DESCRIPTION OF PARTICULAR EMBODIMENTS

Figure 1:
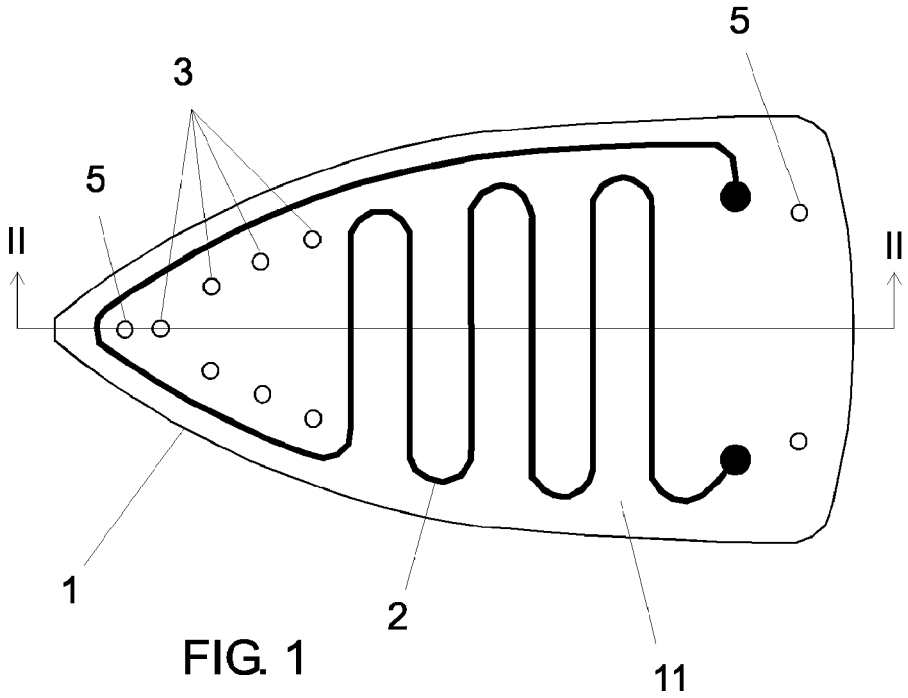
FIG. 1 is a plant view of the inner side of an embodiment of a soleplate according to the invention.
Figure 2:
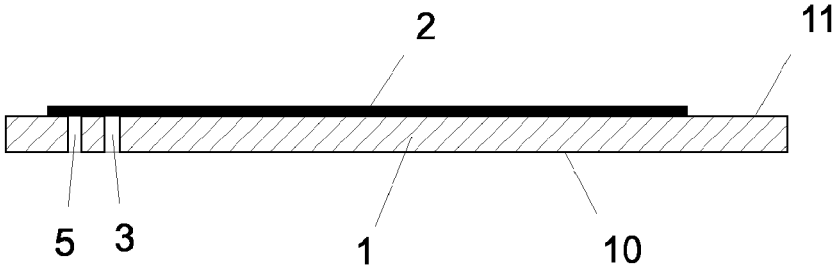
FIG. 2 is a cross-section view of the soleplate of FIG. 1 taken along the line II-II.
Figure 3:
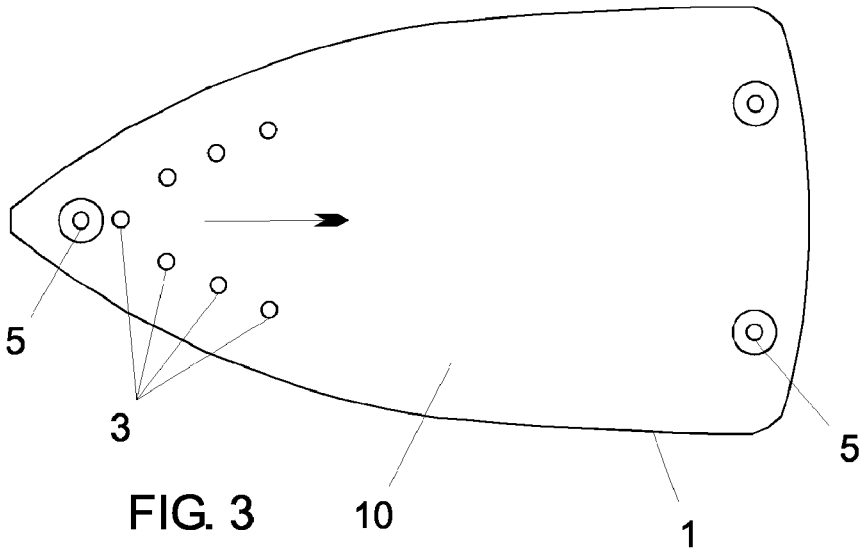
FIG. 3 is a plant view of the outer side of the soleplate of FIG. 1.
Figure 4:
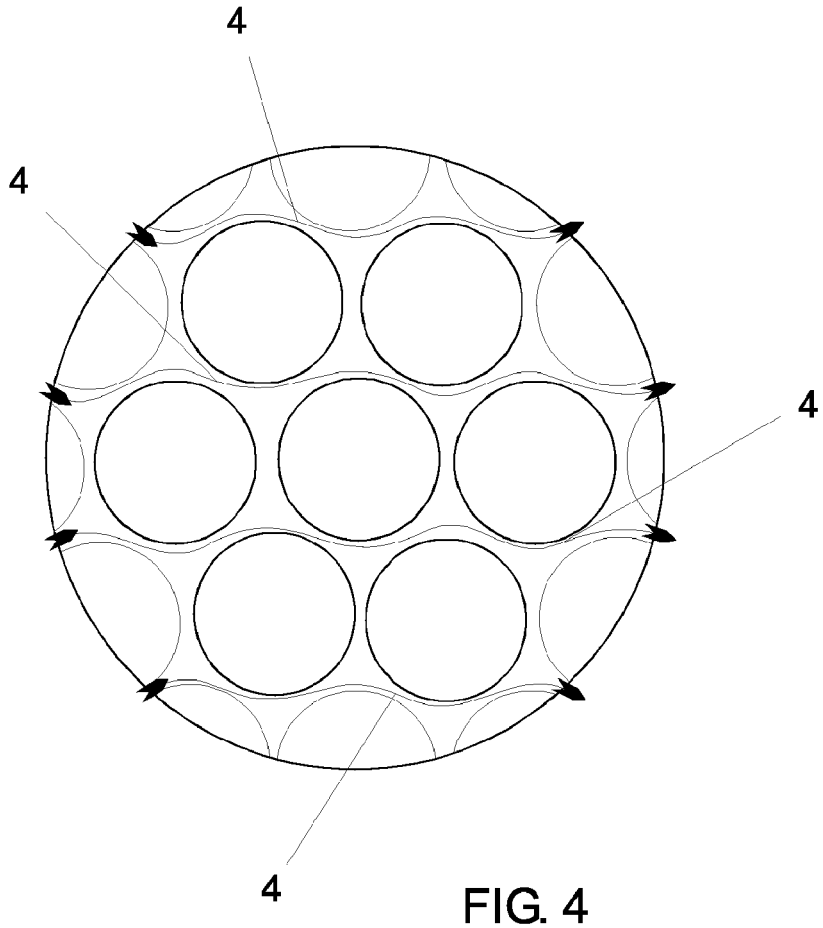
FIG. 4 is an enlarged view of a detail of FIG. 3.

FIGS. 1 to 4 show an embodiment of an iron's soleplate according to the invention. The soleplate comprises a body 1 and a heating element 2 that heats said body.

The body 1 is formed of one piece that is a ceramic plate. In this embodiment the ceramic material is a glass-ceramic material, therefore the soleplate's body is a glass-ceramic plate 1. The plate 1 has an ironing outer side 10 and an inner side 11.

The glass-ceramic plate 1 is made in two main steps. In the first main step the raw material is melt, laminated, cooled and shaped to the desired shape. In the second main step the material is subjected during about ten minutes to a thermal treatment taking place at a temperature of about 850° C.

The thickness of the plate 1 is chosen in the range 2-5 mm, preferably 3-4 mm.

In an embodiment, the composition of a glass-ceramic plate 1 suitable for a soleplate according to the invention has the following components and ranges:

[55-75]% by weight of $SiO_2$
[1-10]% by weight of $P_2O_5$
[0-25]% by weight of $LiO_2$
[0-20]% by weight of $Al_2O_3$
[0-20]% by weight of ZnO
[0-10]% by weight of MgO
[0-10]% by weight of $B_2O_3$ Some examples of specific compositions may be (percentages by weight):

74% of $SiO_2$, 4% of $LiO_2$, 16% of $Al_2O_3$ and 6% of $P_2O_5$.

65% of $SiO_2$, 9% of MgO, 19% of $Al_2O_3$ and 7% of $P_2O_5$.

73% of $SiO_2$, 11% of $LiO_2$, 7% of MgO, 6% of $B_2O_3$ and 3% of $P_2O_5$.

58% of $SiO_2$, 23% of $LiO_2$, 16% of ZnO and 3% of $P_2O_5$

The heating element is a resistance 2 screen-printed on the inner side 11 of the plate 1. Said resistance is applied before subjecting the plate 1 to said thermal treatment. Specifically, firstly a screen made of a stainless steel mesh is placed on the inner side of the plate, the openings of the mesh constituting the geometry of the resistance to be applied; then some ink is applied on the screen, making as much passes as necessary to reach the resistance's desired thickness. The ink passes just through the openings of the screen and only prints the desired geometry. The resistance, once screen-printed, is dried at about 100° C. Then the glass-ceramics plate 1 provided with the screen-printed resistance 2 is subjected to said thermal treatment (850° C. during ten minutes).

In a screen-printing process several layers of different inks may be deposited:

Conductive inks made of metal powders (Pt, Pd, Ag, Au, etc) and also of additives, binder and excipient.

Resistive inks made of metals or metal oxides ($RuO_2$, $Bi_2Ru_2O_7$, Pd, Ag, etc) and also of additives, binder and excipient.

Dielectric inks made of $BaTiO_3$ or glass, and also of additives, binder and excipient.

The resistive ink is the one applied to form the resistance itself; the conductive ink is applied to form the electric connections, and the dielectric ink, or an epoxy resin, silicone or a similar material as well, is used to coat and protect the resistance. The inner side 11 of the plate 1 does not require any other glass, ceramic or metallic coating.

Thus, the screen-printed resistance is coated with a dielectric layer. In an embodiment, the inner side of the ceramic plate is only coated with said screen-printed resistance. In this way, it is avoided for the resistance to be embedded in the soleplate while managing to have it well protected.

Some steam outlets 3 are provided at the front region of the plate 1, which corresponds to the forward ironing movement of the iron. By coming out at the forward region, the steam tends to go back on the outer side 10 of the plate 1 (indicated by the arrow in FIG. 3). In order to make the steam distribution more uniform on the surface of the outer side 10, said surface is uniformly granulated, thus forming some micro-channels 4 (see FIG. 4, in which the arrows indicate the steam circulation) that efficiently guide the steam towards the back region of the glass-ceramic plate 1.

The dimensions of the micro-channels 4 are selected among: 50-200 μm deep, preferably 100-175 μm deep, and 1-2 mm wide, preferably 1.25-1.75 mm wide.

The plate 1 can be provided with some holes 5 for fastening the soleplate to the iron's case (not shown), or else the soleplate can be fastened to the case by any suitable means.

In other embodiments, the ceramic material of the plate 1 is made of alumina ($Al_2O_3$). As in the previous embodiment, after the screen-printing the plate is put in an oven at about 850° C. during about ten minutes. Once it has cooled, the outer face 10 of the alumina plate 1 is polished. The alumina is selected with a purity of 90-99%.

Analogously, the thickness of the plate 1 is in the range 2-4 mm.

Figure 5:
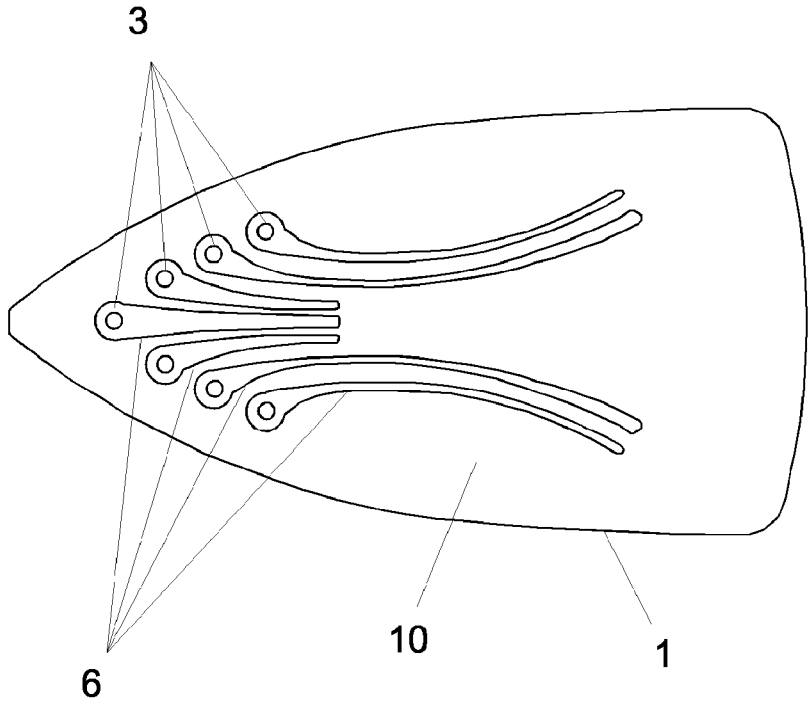
FIG. 5 is a view similar to that of FIG. 3 but of another embodiment.

In the embodiment shown in FIG. 5, the alumina plate 1 is provided with some channels 6 starting from the steam outlets 3 that distribute the steam towards the back region of the plate. For the rest, said alumina plate is analogous to the glass-ceramics plate described above, although in a preferred embodiment the alumina plate is fastened to the iron's case through the inner side of the soleplate.

The present invention extends naturally to an iron comprising a soleplate as described herein.

Although only particular embodiments of the invention have been shown and described in the present specification, the skilled man will be able to introduce modifications and substitute any technical features thereof with others that are technically equivalent, depending on the particular requirements of each case, without departing from the scope of protection defined by the appended claims.

It is clear, for instance, that the screen-printed resistances can have any geometry compatible with the plate's shape, and the same happens with the micro-channels 4 and the channels 6. Both the micro-channels 4 and the channels 6 can be provided in combination with any of the described plates 1 (either glass-ceramic or alumina plates).

It is clear too that the steam outlets 3 can be distributed on the plate 1 in any suitable way.

The invention claimed is:

1. A soleplate for an iron comprising a body and a heating element for heating said body, wherein said body is a single ceramic plate having an ironing outer side and an inner side, wherein said heating element comprises at least one screen-printed resistance on said inner side of the ceramic plate, wherein the ceramic plate includes one or more steam outlets; and, wherein the ironing outer side of the ceramic plate is uniformly granulated forming a plurality of micro-channels for distributing steam.

2. A soleplate according to claim 1, wherein the ceramic plate is made of a glass-ceramic material.

3. A soleplate according to claim 1, wherein the ceramic plate is made of alumina.

4. A soleplate according to claim 1, wherein the thickness of the ceramic plate is in the range of between about 2 and about 5 mm.

5. A soleplate according to claim 4, wherein the thickness of the ceramic plate is in the range of between about 3 and about 4 mm.

6. An iron comprising a soleplate which comprises a body and a heating element for heating said body, wherein said body is a single ceramic plate having an ironing outer side and an inner side, wherein said heating element comprises at least one screen-printed resistance on said inner side of the ceramic plate, wherein the ceramic plate includes one or more steam outlets; and wherein the ironing outer side of the ceramic plate is uniformly granulated forming a plurality of micro-channels for distributing steam.

7. An iron according to claim 6, wherein the ceramic plate is made of a glass-ceramic material.

8. An iron according to claim 6, wherein the ceramic plate is made of alumina.

9. An iron according to claim 6, wherein the thickness of the ceramic plate is in the range of between about 2 and about 5 mm.

10. An iron according to claim 9, wherein the thickness of the ceramic plate is in the range of between about 3 and about 4 mm.

11. A soleplate for an iron comprising a body and a heating element for heating said body, wherein said body is a single glass-ceramic plate having an ironing outer side and an inner side, and wherein said heating element comprises at least one screen-printed resistance on said inner side of the glass-ceramic plate.

12. A soleplate according to claim 11, wherein the glass-ceramic plate includes one or more steam outlets, and wherein the ironing outer side of the glass-ceramic plate is uniformly granulated forming a plurality of micro-channels for distributing steam.

13. A soleplate according to claim 11, wherein the glass-ceramic plate includes one or more steam outlets, and wherein the ironing outer side of the glass-ceramic plate includes one or more channels for distributing steam.

14. A soleplate according to claim 11, wherein the thickness of the glass-ceramic plate is in the range of between about 2 and about 5 mm.

15. A soleplate according to claim 14, wherein the thickness of the glass-ceramic plate is in the range of between about 3 and about 4 mm.

16. An iron comprising a soleplate which comprises a body and a heating element for heating said body, wherein said body is a single glass-ceramic plate having an ironing outer side and an inner side, and wherein said heating element comprises at least one screen-printed resistance on said inner side of the glass-ceramic plate.

17. An iron according to claim 16, wherein the glass-ceramic plate includes one or more steam outlets, and wherein the ironing outer side of the glass-ceramic plate is uniformly granulated forming a plurality of micro-channels for distributing steam.

18. An iron according to claim 16, wherein the glass-ceramic plate includes one or more steam outlets, and wherein the ironing outer side of the glass-ceramic plate includes one or more channels for distributing steam.

19. An iron according to claim 16, wherein the thickness of the glass-ceramic plate is in the range of between about 2 and about 5 mm.

20. An iron according to claim 19, wherein the thickness of the glass-ceramic plate is in the range of between about 3 and about 4 mm.

* * * * *